United States Patent [19]

Schmerler

[11] Patent Number: 4,964,182

[45] Date of Patent: Oct. 23, 1990

[54] TRANSFER AID WITH AUXILIARY SUPPORT SYSTEM

[76] Inventor: Joseph Schmerler, 140 Devom Rd., Tenafly, N.J. 07670

[21] Appl. No.: 468,366

[22] Filed: Jan. 22, 1990

Related U.S. Application Data

[63] Continuation-in-part of Ser. No. 304,467, Feb. 1, 1989, Pat. No. 4,894,871.

[51] Int. Cl.[5] ..... A61G 7/10

[52] U.S. Cl. ..... 5/81 R; 135/67; 5/503; 5/507

[58] Field of Search ..... 5/81 R, 445, 503, 507, 5/508; 135/67; 4/254; 272/68, 70.2, 900

[56] References Cited

U.S. PATENT DOCUMENTS

| | | | |
|---|---|---|---|
| 2,445,619 | 7/1948 | Josephs | 5/507 X |
| 3,553,746 | 1/1971 | Seiger | 5/503 |
| 3,591,874 | 7/1971 | O'Kennedy | 5/503 X |
| 4,411,283 | 10/1983 | Lucarelli | 135/67 |
| 4,474,202 | 10/1984 | Blechner | 135/67 |
| 4,894,871 | 1/1990 | Schmerler | 135/67 X |

FOREIGN PATENT DOCUMENTS

| | | | |
|---|---|---|---|
| 1465277 | 2/1977 | United Kingdom | 135/67 |
| 1498895 | 1/1978 | United Kingdom | 135/67 |

*Primary Examiner*—Michael F. Trettel
*Attorney, Agent, or Firm*—Natter & Natter

[57] ABSTRACT

A transfer aid for elderly or infirm individuals includes a selectively swingable and longitudinally extendable center frame member which provides alternate support modes. When the center frame member is secured in a vertical operational mode, a plurality of assist bars are hand reachable from a seated position for initiating a pivotal weight transfer about a footpad to effect a transition from a seated to a standing position. When the center frame is displaced to a horizontal operational mode, an auxiliary support surface is adjustably positionable and readily accessible to the seated user.

11 Claims, 2 Drawing Sheets

TRANSFER AID WITH AUXILIARY SUPPORT SYSTEM

CROSS-REFERENCE TO RELATED APPLICATION

This application is a continuation-in-part of co-pending application Ser. No. 304,467 filed 2/1/89 to be issued as U.S. Pat. No. 4,894,871.

FIELD OF THE INVENTION

This invention relates generally to ambulation and support appliances for physically impaired individuals and especially to an aid for assisting weight transference during transition from a seated to a standing position.

In particular, the transfer aid of this invention incorporates a selectively swingable frame member for providing an auxiliary support system.

BACKGROUND

The transfer aid of the reference U.S. patent application Ser. No. 304,467 concerns a space frame comprised of parallel rail members and includes an integral front section having a plurality of assist bars which are utilized for initiating a pivotal movement from a seated to a standing position and for providing lift support to the user while attaining a standing position. The space frame of that application does not include an auxiliary support.

In addition, a rear section of the previously described space frame, requires securement to a commode or similar seating device when in use.

Although the structure of the transfer aid disclosed in that application is well suited for its intended purposes, there are inherent limitations with regard to the scope of employment. For example, that device may not be readily adaptable for use with conventional seating devices and similar furniture.

Additionally, the aforementioned transfer device does not include ancillary support surfaces accessible to the user while seated.

Thus it will be seen that the improved structural arrangement of the instant invention enhances the utility of the former transfer aid and provides a wider range of applications.

BRIEF SUMMARY OF THE INVENTION

The transfer aid of this invention includes a space frame comprised of parallel rail members. A rear section of the space frame is adapted for positioning under a chair without attachment thereto and functions to stabilize the space frame. A front section of the space frame includes a center frame slidably mounted within a pivot sleeve assembly. The center frame is adapted for rotational displacement between a substantially vertical and a horizontal plane. When the center frame is in the vertical orientation, a plurality of assist bars are placed within hand-reachable distance from a user seated on the chair. The assist bars are utilized in conjunction with a footpad secured to a median section of the space frame, for accomplishing a weight transfer and lift support. The footpad further distributes the weight to a horizontal or floor surface. The interface between the space frame and the floor surface includes adjustable leveler members for providing contiguous surface contact.

A feature of this invention is that the center frame is selectively pivotable and includes a platform which provides an auxiliary support system. Additionally, the center frame is horizontally extendable for position adjustment with respect to the user.

Having thus summarized the invention, it will be seen that it is an object thereof to provide an improved transfer aid of the general character described herein which includes an auxiliary support system.

Another object of this invention is to provide a transfer aid having an auxiliary support system that provides for pivotal weight transfer and lift support for assisting movement from a sitting to an erect position.

A further object of this invention is to provide a transfer aid with an auxiliary support system that is functional without attachment to a seating device.

Still another object of this invention is to provide a transfer aid with an auxiliary support system having alternate functional support modes.

Yet another object of this invention is to provide a transfer aid with an auxiliary support system which is simple in construction, reliable in use and well adapted for mass production fabrication techniques.

Other objects of this invention in part will be apparent in part will be pointed out hereinafter.

With these ends in view, the invention finds embodiment in certain combinations of elements and arrangements of parts for which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown an exemplary embodiment of the invention.

DETAILED DESCRIPTION OF THE INVENTION

Figure 1:
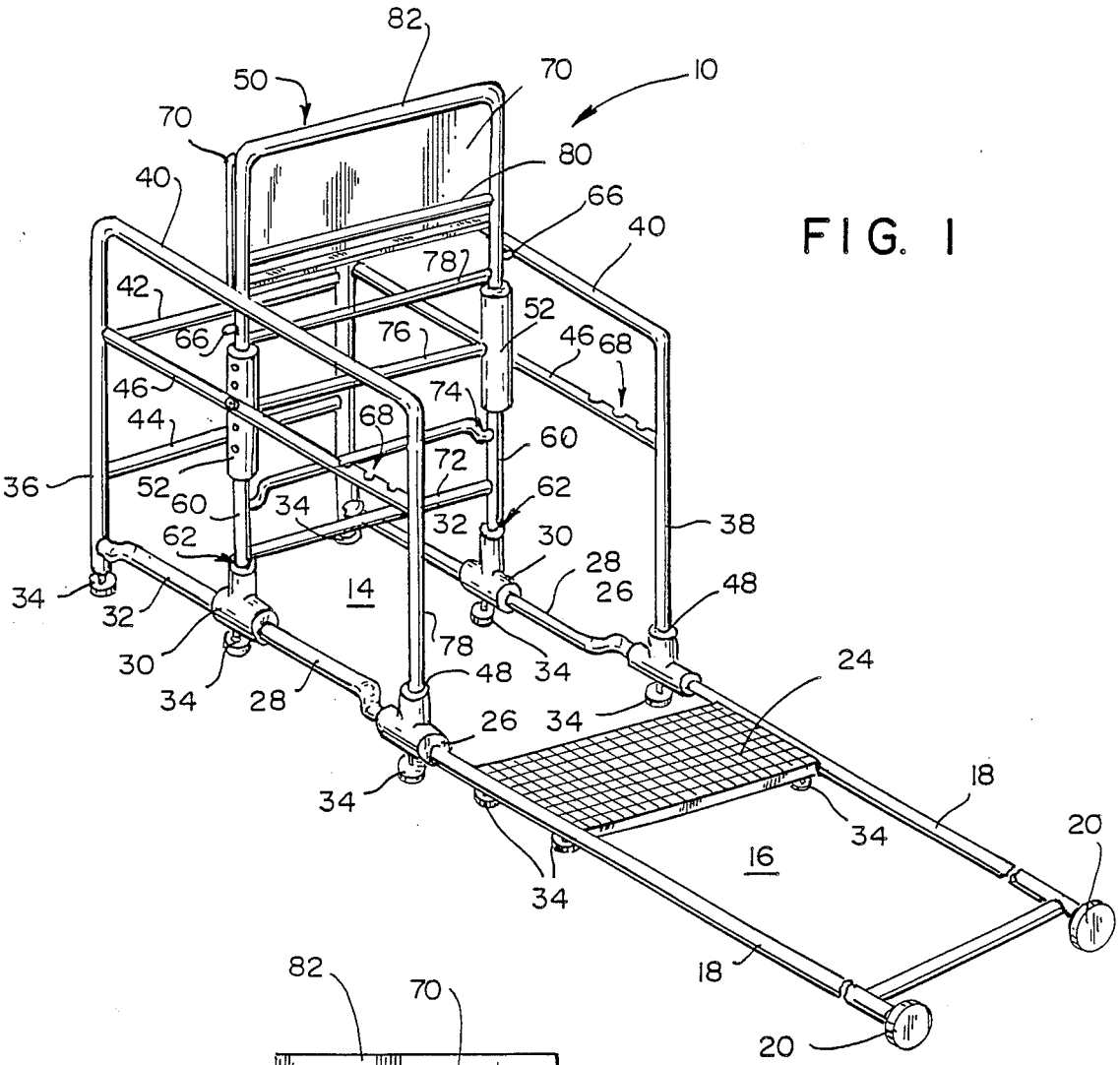
FIG. 1 is a perspective view of the transfer aid of this invention showing an auxiliary support system including a space frame having a pivotally mounted center frame which is vertically oriented in a first operational mode.

Referring now in detail to the drawings, the reference numeral 10 denotes generally the transfer aid with auxiliary support system in accordance with this invention.

The transfer aid 10 is intended for use by elderly, infirm, and physically impaired individuals and relies upon a weight transference about a fulcrum for effecting a pivotal dislocation. This movement is achieved with a minimal amount of muscular exertion when utilizing the apparatus of this invention.

Figure 3:
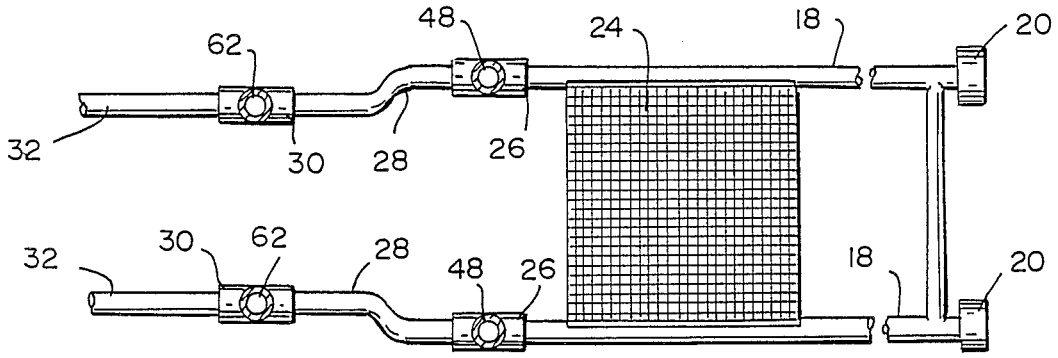
FIG. 3 is a plan view taken substantially along lines 3—3 of FIG. 2 showing a rear and median section of the space frame including a footpad and a set of four "T" connector members for supporting a front section of the space frame.

The transfer aid 10 defines a space frame having a front section 14 and a rear section 16. The device 10 is preferably fabricated of heavy gage steel, stainless steel or chrome-plated tubing of approximately 1 in. outside diameter. A rear section 16 includes parallel linear tubular members or floor rails 18. The distal end of each rail 18 is provided with an end cap 20 which is supported on a floor surface 22. A footpad 24 is secured between the floor rails 18 at a median section of the space frame. A proximal end of each of the floor rails 18 is secured within one end of a "T" connector member 26. A pair of tubular extension members 28 are attached to another end of the "T" connector members 26. The extension members 28 are provided with a curved portion or bend as best shown in FIG. 3. The opposite ends of the extension members 28 terminate at another set of "T" connector members 30 which are parallel to and offset within the parallel axes of the floor rails 18. An additional tubular stub 32 extends forwardly from the "T" connector members 30. An adjustable leveler member 34 is placed under each of the "T" connector members 26, 30 and the footpad 24. In addition, a leveler member 34 is placed under a set of forward legs 36 of the front section 14. The forward ends of the tubular stubs 32 are joined to the legs 36 adjacent the leveler members 34. The leveler members 34 preferably include a threaded stud and a rotatable foot member which engages the threaded stud as described in the previously referred to co-pending application.

Figure 2:
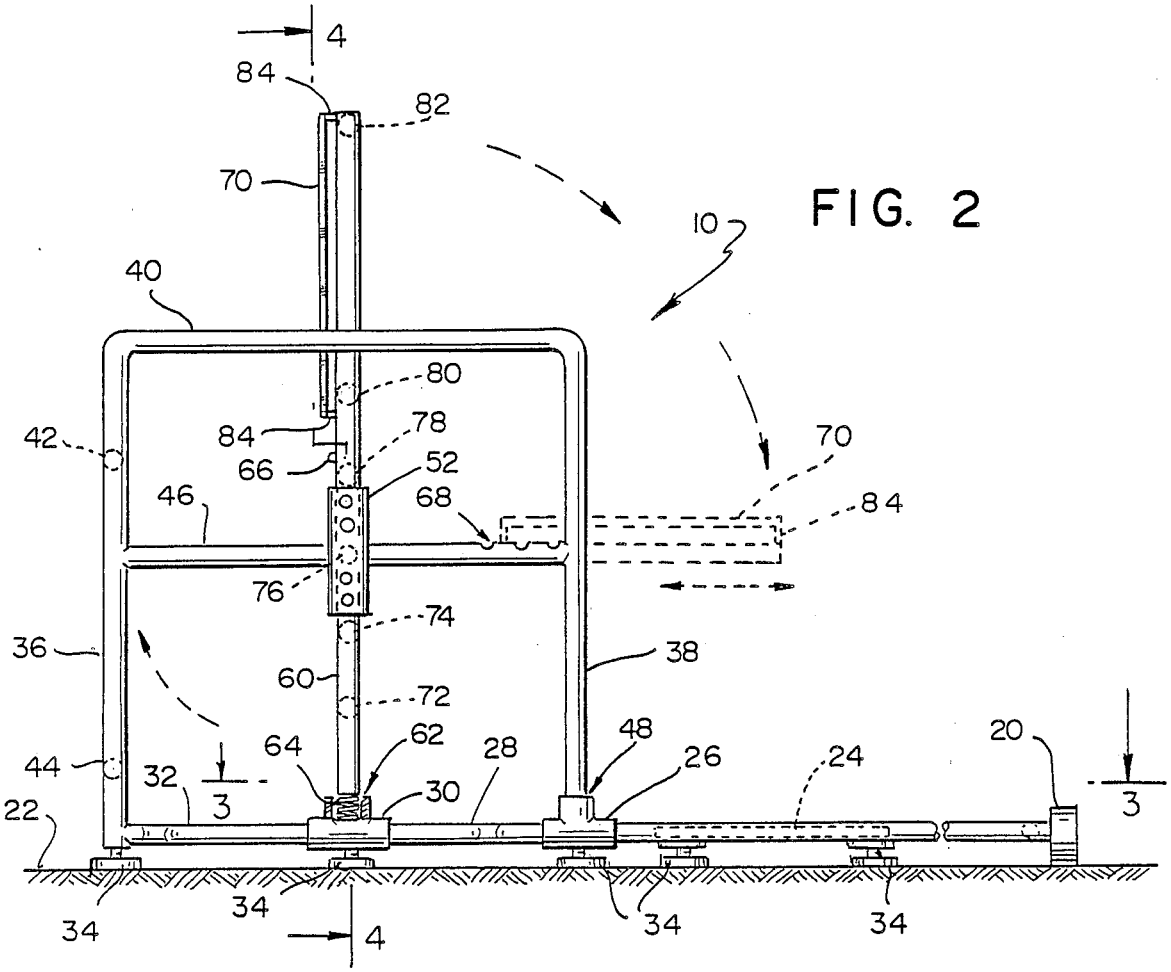
FIG. 2 is an elevational view of the transfer aid illustrating, by arrows and in broken-line, the center frame rotationally displaced to a horizontal second operational mode.

The front section 14 will now be described with particular reference to FIGS. 1 and 2. The pair of front legs 36 and a pair of rear legs 38 support a set of substantially horizontal hand rails 40. An upper cross bar 42 and a lower cross bar 44 span between the front legs 36 for providing structural rigidity to the space frame. In addition, a pair of side bars 46 extend between the front legs 36 and the rear legs 38. As previously mentioned, the front legs 36 include leveler members 34 for contact with the floor surface 22. The rear legs 38 however, terminate within a neck opening or socket 48 of the "T" connector members 26.

Figure 5:
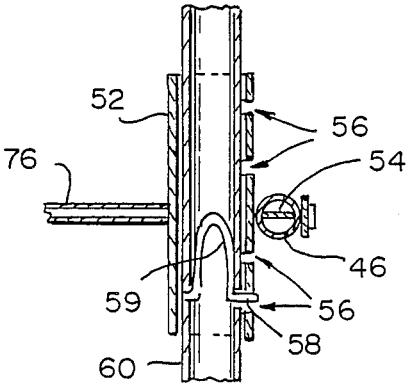
FIG. 5 is an enlarged sectional view showing a spring-urged pin member extending from within a longitudinal leg of the center frame with the pin member engaged within one of a plurality of aligned apertures in the sleeve assembly.

A center frame 50 includes a set of spaced longitudinal leg members 60 which are slidably mounted within a sleeve assembly having complementary sleeve members 52. The sleeves 52 include an integral shaft 54 which extends through the respective side bars 46 and is journaled for rotational displacement. The sleeves 52 further include a plurality of aligned apertures 56 which are adapted for registration with a yieldable pin member 58 mounted respectively within and projecting from each of the leg members 60 of the center frame 50. A typical pin 58 is illustrated in FIG. 5 which includes a spring 59; equivalent devices may also be used and are known in the art. The pin member 58 is adapted for registered engagement with a selected aperture 56 of the sleeve 52 to provide incremental adjustable positioning during extendable displacement of the center frame 50. The leg members 60 can be released by the application of an inwardly directed force to depress the pin member 58 and permit relative movement with respect to the sleeve 52.

Figure 4:
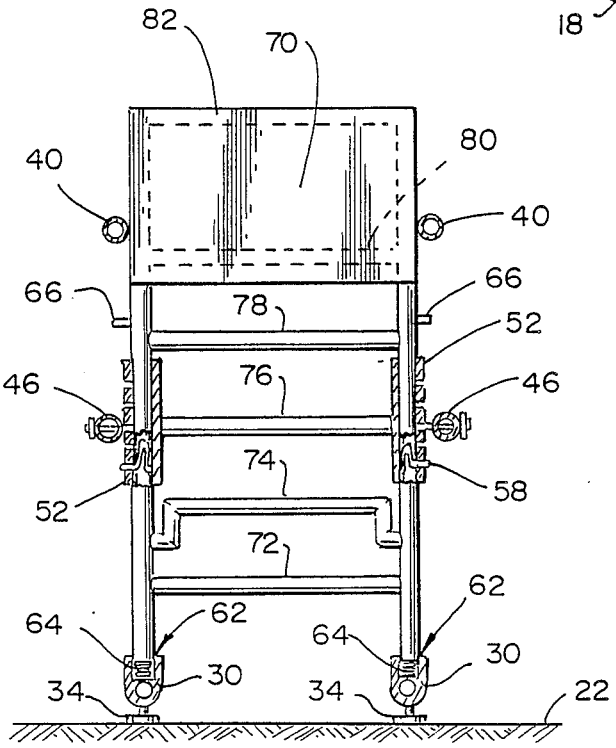
FIG. 4 is a sectional view taken substantially along line 4—4 of FIG. 2 showing the center frame slidably mounted within a sleeve assembly and seated within the "T" connector members.

When the center frame 50 is in a vertical or first operational mode, the leg members 60 are adapted to seat within a co-axial neck opening or socket 62 of the "T" connector members 30. The pin members 58 will be in the lowermost aperture 56 as illustrated in FIG. 4. A compression spring 64 or an equivalent resilient member contained within the socket 62 urges the leg member 60 free of the socket 62. When the pin member 58 is depressed to release the leg member 60, a spring force will displace the center frame 50 upwardly and the pin member 58 will enter the next adjacent aperture 56 of the sleeve member 52. This movement can also be supplemented by a user applied upward force. The center frame 50 will then be rotatable approximately 90 degrees from the vertical to a substantially horizontal or second operation mode as illustrated by the broken-line and arrows in FIG. 2.

A set of wing members 66 are adapted to engage a selected notch 68 in the side bar 46 and to provide a limit stop when the center frame member 50 in a horizontal mode. It should be noted that the center frame 50 can further be extended utilizing the cooperative interaction between the pin member 58 and the apertures 56. The plurality of notches 68 are adapted to receive the wing member 66 during this incremental extension adjustment.

The center frame 50 also includes a platform 70 which provides an auxiliary horizontal support surface. The platform 70 can for example, be provided with a cushion so as to function as a foot rest. In addition, a food tray can be placed upon the platform 70 for the convenience of the user while in a seated position. It should also be obvious that the platform 70 can be used for such other purposes as to support a telephone, radio, television set or for a writing table.

The center frame 50 will now be described in connection with its use during transition to a standing position. When the center frame is pivotally returned to a vertical plane it can be slidably positioned within the sleeves 52 such that the legs 60 are lockingly engaged within the socket 62 of the "T" connector 30.

A plurality of transfer assist bars 72, 74, 78 and 80 extend between the longitudinal leg members 60. Also, a top bar 82 connects the leg members 60 at its uppermost extremity. Additionally, an assist bar 76 spans between the respective sleeve members 52 and is preferably welded thereto.

It should also be noted that a set of stand-off block members 84 are placed between the platform 70 and the leg member 60 to offset the platform 70 so that the user will have clearance for hand access to the assist bar 80 and the top bar 82.

In operation, the user's feet are placed upon the footpad 24 while in a seated position. When the user desires to stand, he leans forward and grabs one of the assist bars 72–80 and pulls back on the respective assist bar or leans forward and straightens his legs. This action shifts the center of gravity and the user's weight is gradually transferred to the footpad 24. By further pulling on the selected assist bar, the user's body is pivoted without the footpad 24 which acts as a fulcrum. The weight of the user is simultaneously distributed through the leveler members 34 and the end caps 20 to the floor surface 22. The floor rails 18 do not require attachment to the seating device and function as a resistance lever to oppose the force generated as the user pulling upwardly on the assist bars.

The user, at this stage, is in a bent over position and achieves lift support to attain an erect attitude by sequentially placing his hands on progressively higher assist bars 72–80 until arriving at the top bar 82 and the hand rails 40 and thus assuming a standing position.

It should thus be seen that there is provided a transfer aid with auxiliary support system that achieves the various objects of this invention and which is well adapted to meet conditions of practical use.

Since various possible embodiments might be made of the present invention or modifications might be made to the exemplary embodiments set forth, it is to be understood that all materials shown and described in the accompanying drawings are to be interpreted as illustrative and not in a limiting sense.

Having thus described the invention, there is claimed as new and desired to be secured by Letters Patent:

1. A transfer aid for assisting weight transfer of a user between a seated and a standing position comprising a space frame having a front section which includes a center frame, said center frame being pivotally mounted to the front section, locking means for releasably securing the center frame in a substantially vertical operational mode, said center frame further including at least one assist bar adapted for hand reachable grasp by the seated user to initiate a pivotal movement from a seated to a standing position, said center frame further being releasable from the locking means for rotational displacement to a substantially horizontal operational mode for providing an auxiliary support surface.

2. A transfer aid as claimed in claim 1 further including a rear section, said rear section including substantially linear parallel rail members, said rail members being positionable along a horizontal support surface to provide resistance leverage in opposition to an upward force generated by the user upon the assist bar.

3. A transfer aid as claimed in claim 2 further including a footpad secured to the parallel rail member at a median section of the space frame, said footpad being adapted to stabilize the space frame by transmitting the weight of the user to the horizontal support surface.

4. A transfer aid as claimed in claim 1 wherein the center frame is slidably extendable with respect to the front section for adjustable positioning of the auxiliary support surface.

5. A transfer aid as claimed in claim 1 wherein the center frame includes a set of spaced longitudinal leg members, a plurality of transfer assist bars connected to and spanning between said leg members, wherein said leg members are slidably mounted within a sleeve assembly, said sleeve assembly being pivotally secured to the front section of the space frame.

6. A transfer aid as claimed in claim 5 wherein the sleeve assembly includes a set of sleeve members and an integral assist bar extending between said sleeve members.

7. A transfer aid as claimed in claim 6 further including sleeve engagement means for cooperative interaction between at least one sleeve member of the set and a corresponding longitudinal leg of the center frame to provide incremental adjustment positioning of the center frame with respect to the sleeve assembly.

8. A transfer aid as claimed in claim 7 wherein the sleeve engagement means includes a plurality of apertures in at least one of said sleeve members, a spring urged pin within a corresponding longitudinal leg, said pin projecting from the longitudinal leg and being adapted for releasable accommodation within a selected aperture of the sleeve member to prevent relative movement therebetween.

9. A transfer aid as claimed in claim 1 wherein the center frame includes a set of spaced longitudinal leg members, and the locking means for securing the center frame in a substantially vertical operational mode includes a connector member defining a socket, said socket being coaxial with at least one of the longitudinal leg, said longitudinal leg being insertable within the socket to prevent rotational displacement of the center frame.

10. A transfer aid as claimed in claim 9 further including spring means within the socket, said spring means urging the center frame upwardly upon release of the sleeve engagement means to release the center frame for rotational displacement.

11. A transfer aid for assisting weight transfer of a user between a seated and a standing position comprising a space frame including a rear section adapted for positioning along a floor surface and beneath a sitting device, a front section including a pair of substantially vertical front and rear leg members and a side bar extending between said respective front and rear leg members, a center frame pivotally secured to the side bars, said center frame including at least one transverse assist bar adapted for hand reachable grasp by a seated user, further including locking means for securing the center frame in a substantially vertical operational mode, said center frame being adapted for rotational displacement upon release of the locking means to a substantially horizontal operational mode for providing an auxiliary support surface.

* * * * *